US007284829B2

(12) United States Patent
Fang et al.

(10) Patent No.: US 7,284,829 B2
(45) Date of Patent: Oct. 23, 2007

(54) INKJET PRINTHEAD AND PROCESS FOR PRODUCING THE SAME

(75) Inventors: Yu-Jen Fang, Taichung (TW); Chin-Horng Wang, Shinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 149 days.

(21) Appl. No.: 10/950,508

(22) Filed: Sep. 28, 2004

(65) Prior Publication Data

US 2006/0001701 A1 Jan. 5, 2006

(30) Foreign Application Priority Data

Jun. 30, 2004 (TW) ..... 93119238 A

(51) Int. Cl.
*B41J 2/14* (2006.01)
*B41J 2/16* (2006.01)

(52) U.S. Cl. ..... 347/48; 347/68

(58) Field of Classification Search ..... 347/20, 347/48, 55, 70–71, 63, 65, 67–68, 94, 54, 347/56

See application file for complete search history.

(56) References Cited

U.S. PATENT DOCUMENTS 5,204,689 A * 4/1993 Shirato et al. ..... 347/58
6,102,530 A 8/2000 Kim et al. ..... 347/65
6,799,834 B2 * 10/2004 Fujii et al. ..... 347/54

FOREIGN PATENT DOCUMENTS

TW 487638 9/2001
TW 519518 1/2002

* cited by examiner

*Primary Examiner*—Juanita D. Stephens
(74) *Attorney, Agent, or Firm*—Troxell Law Office, PLLC

(57) ABSTRACT

An inkjet printhead and process for producing the same, having at least an auxiliary actuator being added in the inkjet printhead structure, is able to increase the frequency response thereof and to increase the positioning precision and structure rigidity of the inkjet printhead by using a single wafer bonding step in the process of producing the same.

7 Claims, 6 Drawing Sheets

INKJET PRINTHEAD AND PROCESS FOR PRODUCING THE SAME

FIELD OF THE INVENTION

The present invention relates to an inkjet printhead and process for producing the same, and more particularly, to an inkjet printhead with auxiliary actuator and process of making the same.

BACKGROUND OF THE INVENTION

Generally, there are three liquid droplet injection designs capable of ejecting liquid droplet with uniform droplet size, which are thermal bubble inkjet printhead, electrostatic inkjet printhead and piezoelectric inkjet printhead. The present invention will focus on the electrostatic inkjet printhead and piezoelectric inkjet printhead that have the ability to eject liquid droplet without using a thermally driven bubble.

Refer to FIGS. 1A, 1B and 1C, which are schematic diagrams showing successive actions of an electrostatic inkjet printhead of side-shooter design. The printhead 100 adopts the side-shooter design in which the nozzle 110 of the printhead 100 being disposed between substrate 120 and substrate 130 is arranged at a side of an electrostatic actuator 140. As seen in FIG. 1A, the electrostatic actuator 140 is kept in a designated position while the printhead 100 is inactive, and the same time that the chamber 150 formed between the substrate 120 and the electrostatic actuator 140 along with the ink reservoir 160 are filled with ink which flow therein through the ink inlet 170 of the printhead 100.

As seen in FIG. 1B, the electrostatic actuator 140 is distorted downward by the action of the electrostatic attraction while the printhead is activated and ready for ink ejection. As the electrostatic attraction disappears, the distorted electrostatic actuator 140 restores that causes the pressure in the chamber 150 to increase rapidly and enables the ink to be ejected from the nozzle 110.

However, the shortcoming of the printhead 100 is that while the ink in the chamber 150 is being ejected from the nozzle 110, it is also being push to flow back to the ink reservoir 160 as seen in FIG. 1C. In this regard, the backward flow ink will affect the refill speed of the chamber 150 since it is blocking the way for the ink to refill the chamber 150. Therefore, the ejection frequency of the printhead 100 has much to be improved.

Please refer to FIGS. 2A, 2B and 2C, which are schematic diagrams showing successive actions of a electrostatic inkjet printhead of top-shooter design. The printhead 200 of FIG. 2A is similar to the printhead 100 of FIG. 1A, which is composed three substrates 220, 230, and 235, wherein a ink reservoir 260 and an actuator 240 are disposed on the substrate 230, and a nozzle 210 is formed directly on the substrate 220 that is arranged on top of the actuator 240.

While the printhead 200 is inactive and the switch 275 is connected to an off position, the actuator 240 formed of a flexible piezoelectric crystal is kept in a designated position as seen in FIG. 2A. When the switch 275 is on, the actuator 240 is distorted downward by the stimulation of a voltage source as seen in FIG. 2B. As the voltage disappears by switching off the switch 275, the distorted actuator 240 restores that causes the pressure in the chamber 250 corresponding to the actuator 240 to increase rapidly and enables the ink to be ejected from the nozzle 210.

The shortcoming of the printhead 200 is the same as that of the printhead 100. The restoring of the distorted electrostatic actuator 240 not only ejects ink in the chamber 250 from the nozzle 210, but also push it to flow back to the ink reservoir 260 such that the backward flow ink will affect the refill speed of the chamber 250 since it is blocking the way for the ink to refill the chamber 250 in addition, the printhead of top-shooter design will suffer the emergence of satellite droplets.

In view of the above description, the present invention provides an inkjet printhead and process for producing the same, capable of eliminating the emergence of satellite droplets while maintaining a high frequency response.

SUMMARY OF THE INVENTION

It is the primary object of the invention to effectively increase the frequency response of an inkjet printhead. To achieve the abovementioned object, the present invention provide an inkjet printhead, comprising: a first substrate, including a first surface and a second surface and having at least a nozzle formed thereon, and a second substrate, including a first surface and a second surface, wherein the first substrate is connected to the second substrate and the first surface of the second substrate is disposed facing toward the second surface of the first substrate, and the first surface of the second substrate has at least two grooves formed thereon, and the bottom of one of the plural grooves is an actuator while the bottom of another groove is an auxiliary actuator.

The design of the additional auxiliary actuator of the invention not only be applied on a top-shooter inkjet printhead, but also on a side-shooter inkjet printhead.

It is another object of the invention to increase the positioning precision and structure rigidity of an inkjet printhead. To achieve the abovementioned object by using an electrostatic printhead as embodiment, the present invention provide a method for making an inkjet printhead, the method comprising the steps of: forming a first substrate with a layer of electrode; forming a second substrate comprising a main actuator; forming a third substrate having a nozzle arrange thereon directly on top of a first surface of the second substrate; and using a single wafer bonding technique to attach the first substrate onto a second surface of the second substrate.

Operationally, a method for operating the inkjet printhead of the invention is provided to achieve the object of enhancing the frequency response. The operating method includes the step of: deforming an auxiliary actuator for pushing the ink stored in a chamber corresponding to the auxiliary actuator into an ink reservoir and a chamber corresponding to a main actuator; deforming the main actuator for pushing the ink stored in the chamber corresponding to the main actuator so as to enable the ink to be ejected from a nozzle; deforming the auxiliary actuator for refilling the chamber corresponding to the main actuator with the ink stored in the chamber corresponding to the auxiliary after restoring the main actuator to a designated position.

DESCRIPTION OF THE PREFERRED EMBODIMENT

For your esteemed members of reviewing committee to further understand and recognize the fulfilled functions and structural characteristics of the invention, several preferable embodiments cooperating with detailed description are presented as the following.

Both the electrostatic inkjet printhead and piezoelectric inkjet printhead have the shortcoming that while the ink in the chamber is being ejected from the printhead, it is also being pushed to flow back to the ink reservoir, and the backward flow ink will affect the refill speed of the chamber since it is blocking the way for the ink to refill the chamber. Therefore, the inkjet printhead of the invention has at least one auxiliary actuator in addition to the main actuator for preventing the ink to be push back to the ink reservoir such that has a better response frequency.

Although most of the inkjet printhead illustrated in the preferred embodiment of the invention is the electrostatic inkjet printhead, the inkjet printhead of the present invention also can be applied on other non-thermal inkjet printhead, such as piezoelectric inkjet printhead.

Figure 1A:
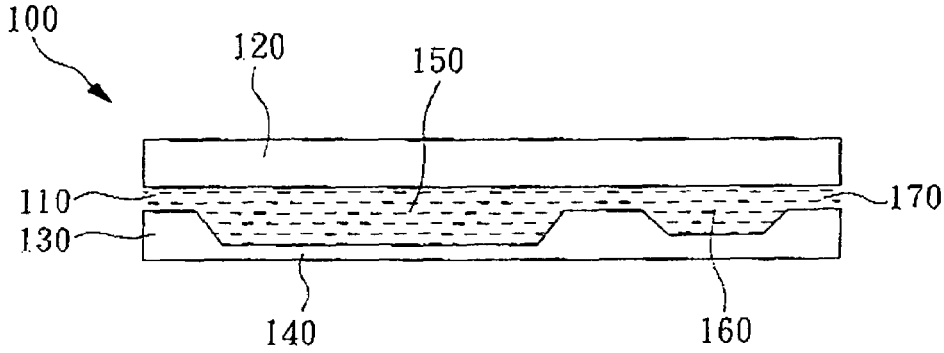
FIG. 1A(PRIOR ART)
FIGS. 1A, 1B and 1C are schematic diagrams showing successive actions of a conventional electrostatic inkjet printhead of side-shooter design.
Figure 1B:
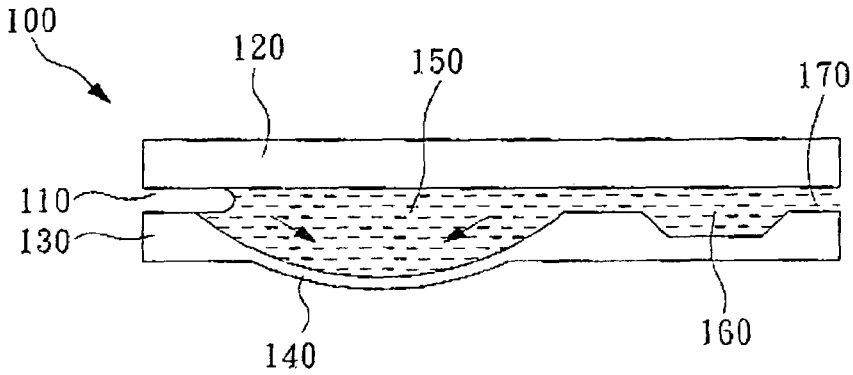
FIG. 1B(PRIOR ART)
Figure 1C:
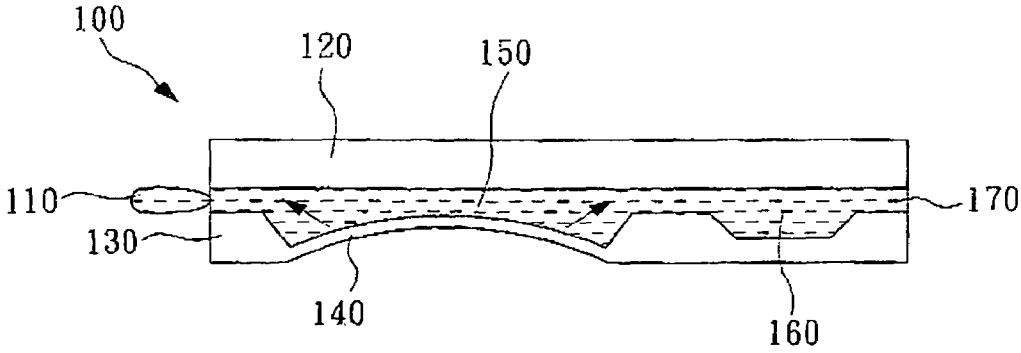
FIG. 1C(PRIOR ART)
Figure 2A:
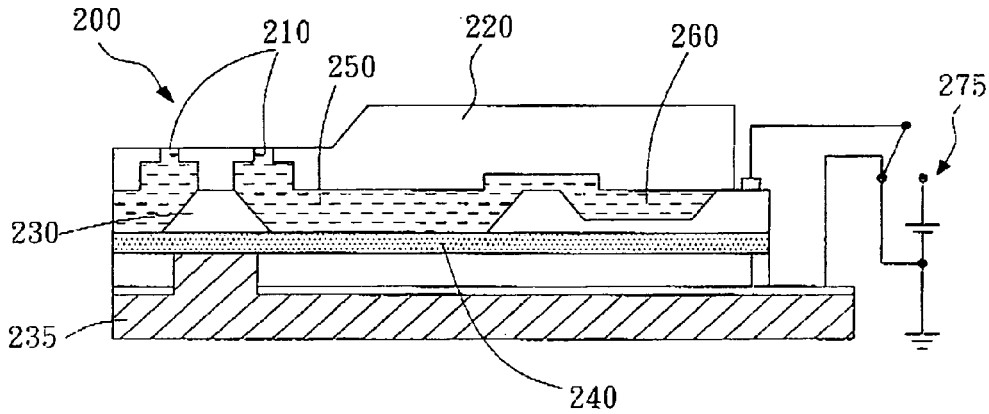
FIG. 2A(PRIOR ART)
FIGS. 2A, 2B and 2C are schematic diagrams showing successive actions of a conventional electrostatic inkjet printhead of top-shooter design.
Figure 2B:
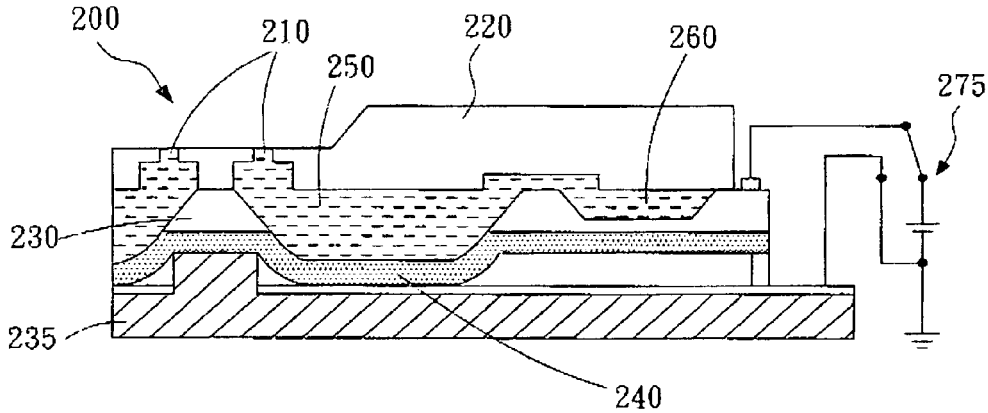
FIG. 2B(PRIOR ART)
Figure 2C:
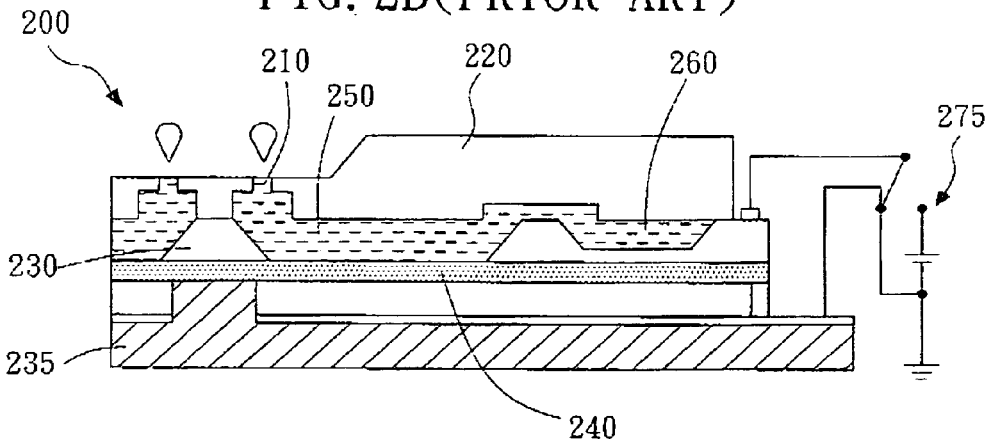
FIG. 2C(PRIOR ART)
Figure 3A:
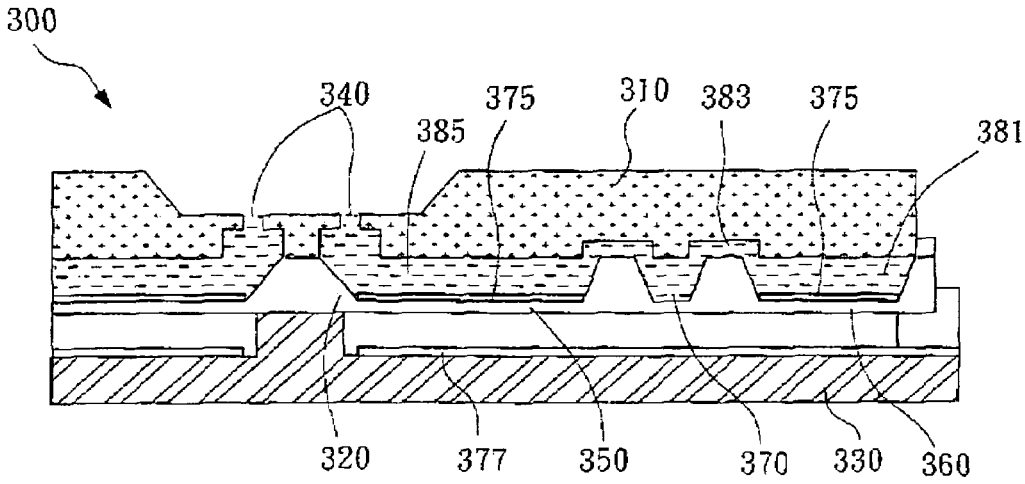
FIG. 3A is an electrostatic inkjet printhead of top-shooter design according to a preferred embodiment of the present invention.
Figure 3B:
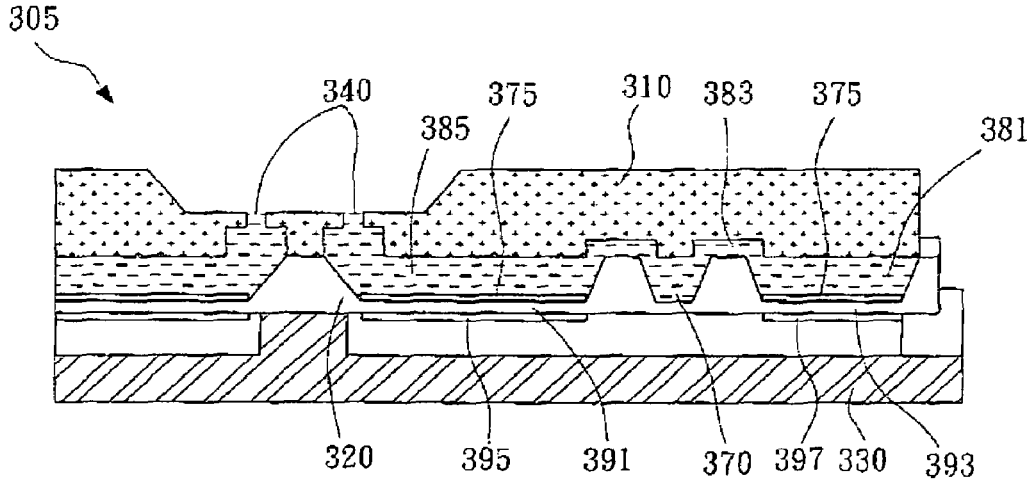
FIG. 3B is a piezoelectric inkjet printhead of top-shooter design according to a preferred embodiment of the present invention.

Please refer to FIG. 3A and FIG. 3B, which are respectively an electrostatic inkjet printhead of top-shooter design and a piezoelectric inkjet printhead of top-shooter design according to the present invention. As seen in FIG. 3A, the electrostatic inkjet printhead 300 of top-shooter design includes three substrates, which are substrate 310, substrate 320 and substrate 330, wherein a nozzle 340 is arranged on the substrate 310, and a main electrostatic actuator 350, an ink reservoir 370 and an auxiliary electrostatic actuator 360 are arranged successively on the surface of the substrate 320. Since the inkjet printhead 300 of the preferred embodiment is an electrostatic inkjet printhead, a layer of electrode 375 is formed on the surface of both the main electrostatic actuator 350 and the auxiliary electrostatic actuator 360 moreover, a layer of electrode 377 is formed on the substrate 330 such that both the main electrostatic actuator 350 and the auxiliary electrostatic actuator 360 can be deformed by charging the two electrode 375, 377 with voltage difference.

While using the auxiliary electrostatic actuator 360 to assist the main electrostatic actuator 350 for ejecting ink from the nozzle 340, the ink will flow from the chamber 381 corresponding to the auxiliary electrostatic actuator 360, the channel 383, the ink reservoir 370, and finally to the chamber 385 corresponding to the main electrostatic actuator 350.

As seen in FIG. 3B, the differences between the piezoelectric inkjet printhead 305 and the foregoing electrostatic inkjet printhead 300 are that the piezoelectric inkjet printhead 305 adopts a main piezoelectric actuator 391 and an auxiliary piezoelectric actuator 393 moreover, the electrode 395 and 397 are attached directly under the main piezoelectric actuator 391 and the auxiliary piezoelectric actuator 393 in respective.

Since the printhead 305 is a piezoelectric inkjet printhead, both the main actuator 391 and auxiliary actuator 393 made of a flexible piezoelectric crystal will deform while the electrode 395, 397 are charged. In addition, the ink in the inkjet printhead 305 flows a path the same as that of the inkjet printhead 300 to be ejected from the nozzle thereof.

Furthermore, the inkjet printing of the present invention can be an inkjet printhead using an main electrostatic actuator cooperating with an auxiliary piezoelectric actuator, or can be an inkjet printhead using an main piezoelectric actuator cooperating with an auxiliary electrostatic actuator, and so on.

In the process for producing the inkjet printhead of the invention, a single wafer bonding technique is used such that the precision for aligning the substrates is improved. Please refer to FIG. 4, which is a series of diagrams depicting processes of producing an electrostatic inkjet printhead of top-shooter design according to the present invention.

Figure 4:
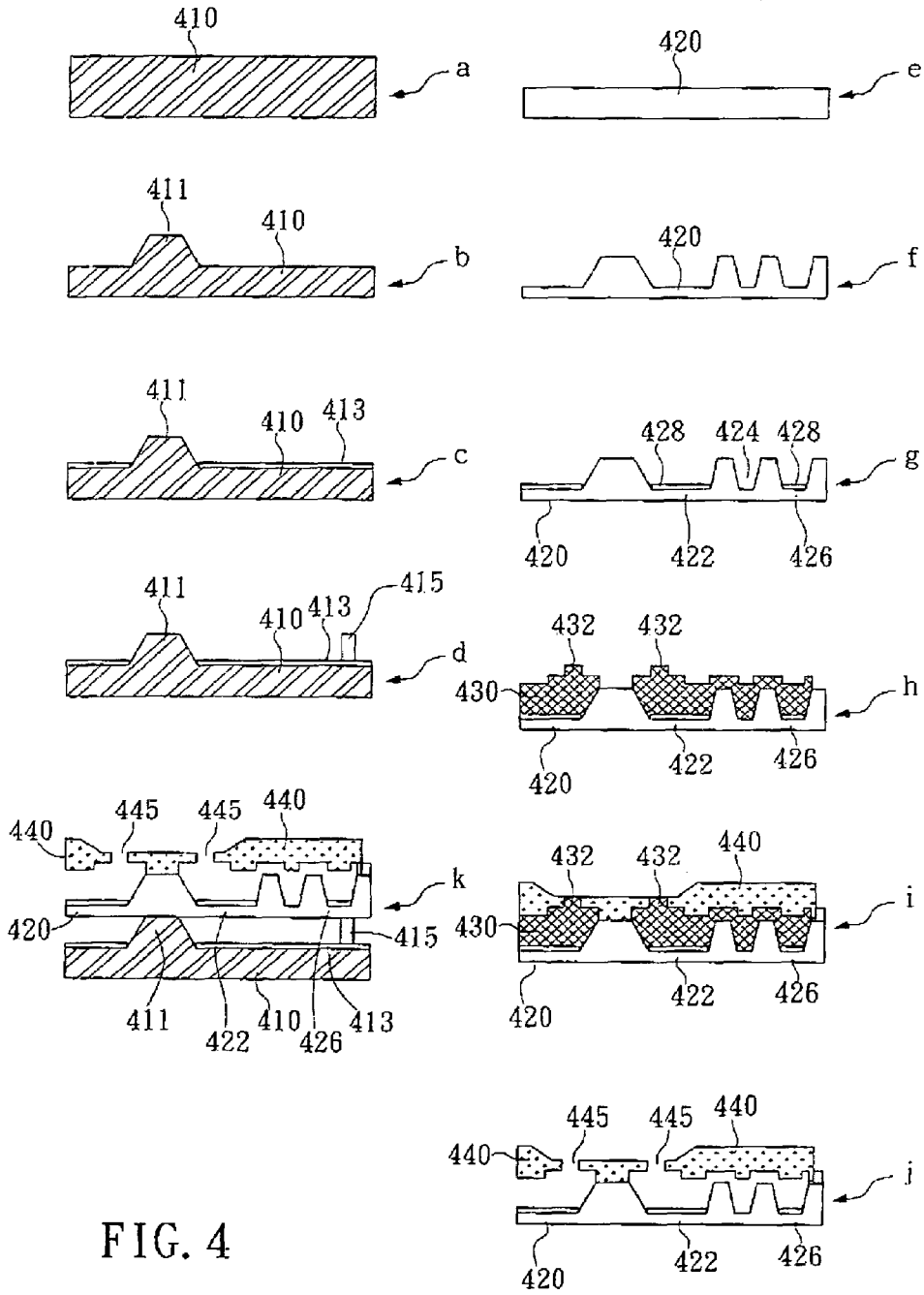
FIG. 4 is a series of diagrams depicting a process of producing an electrostatic inkjet printhead of top-shooter design according to the present invention.

The processes start from step a, that a substrate 410 is provided and the process proceeds to step b. At the step b, a bulge 411 of trapezoid shape is etched in the surface of the substrate 410 using a wet etching or dry etching technique, and the process proceeds to step c. At the step c, a layer of electrode 413 is formed on the surface of the substrate 410 surrounding the bulge 411, however, the piezoelectric inkjet printhead can do without the layer of electrode 413 and the process proceeds to step d. At the step d, a separation wall 415, which is of the same height as the bulge 411, is formed on the surface of the layer of electrode 416 at the position next to the bulge 411. As seen in FIG. 4, the process for forming a substrate 410 with electrode 413 is illustrate form step a to step d.

On the other hand, at the step e, another substrate 420 is provided and the process proceeds to step f. At the step f, a plurality of grooves is formed on the surface of the substrate 420, which can select three of the plural groove in successive and used the three successive grooves as a main electrostatic actuator 422, an ink reservoir 424, and an auxiliary electrostatic actuator 426, and the process proceeds to step g, a layer of electrode 428 is formed on the surface of both the main electrostatic actuator 422 and the auxiliary electrostatic actuator 426 (in a piezoelectric inkjet printhead, a layer of electrode is formed under the actuator thereof as seen in FIG. 3B), and process proceeds to step h, a layer of sacrifice layer is deposited on the surface of the substrate 420, and the sacrifice layer 430 has a bulge 432 thereon which is used for forming a nozzle 445, and the process proceeds to step i. At the step i, a substrate 440 is formed in the surface of the sacrifice layer 430 and the substrate 440 is etched until the bulge 432 is exposed, and the process proceeds to step j. At the step j, the sacrifice layer 430 is etched such that a nozzle 445 is formed on the substrate 440. As seen in FIG. 4, the process for forming a substrate 440 with nozzle 445 directly on the substrate 420 having a main electrostatic actuator 422, and an auxiliary electrostatic actuator 426 is illustrate form step e to step j.

Finally, as seen in FIG. 4, at step k, the substrate 420 formed with the substrate 440 is being attached to the substrate 410 using a single wafer bonding technique.

In the process of prior arts, the substrates are formed individually that two wafer bonding steps are required to attach the three substrate together. In this regard, since the process of the invention use only a single wafer bonding technique to attached the substrate 410 to an integrally formed constituted of substrate 420 and substrate 440, the error generated by the same will be less than that of the prior art using multiple wafer bonding processes in the process so that the precision of manufacturing an inkjet printhead is enhanced. The integrally formed object constituted of substrate 420 and substrate 440 is a monolithic structure that increase and structure rigidity of the inkjet printhead.

Figure 5A:
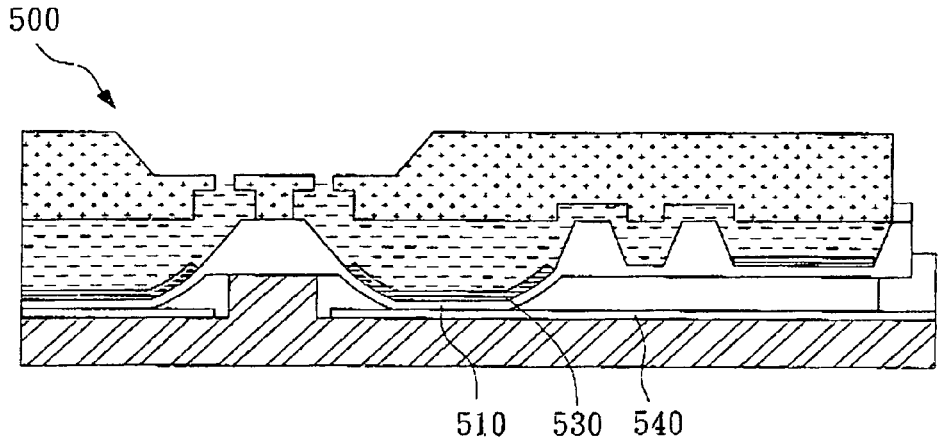
FIGS. 5A, 5B and 5C are schematic diagrams showing successive actions of an electrostatic inkjet printhead of top-shooter design according to the present invention.
Figure 5B:
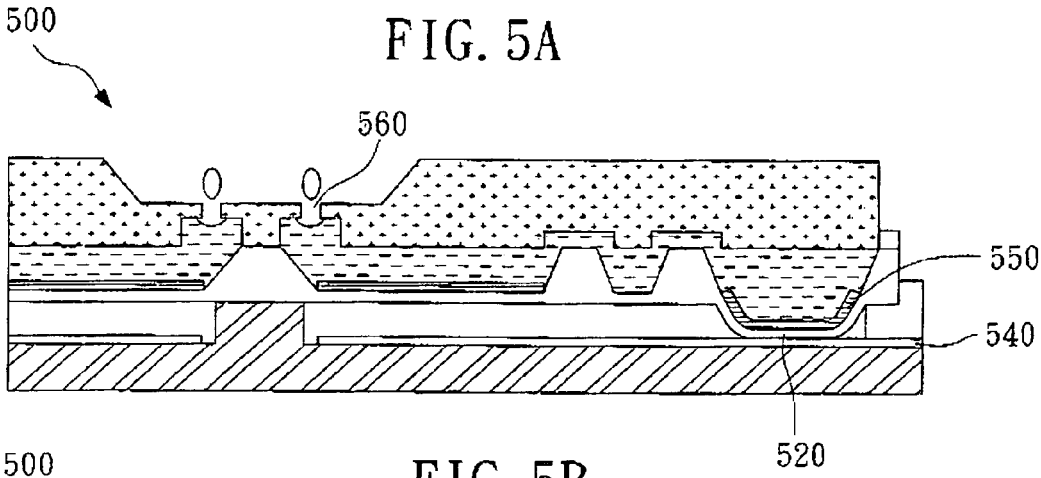
Figure 5C:
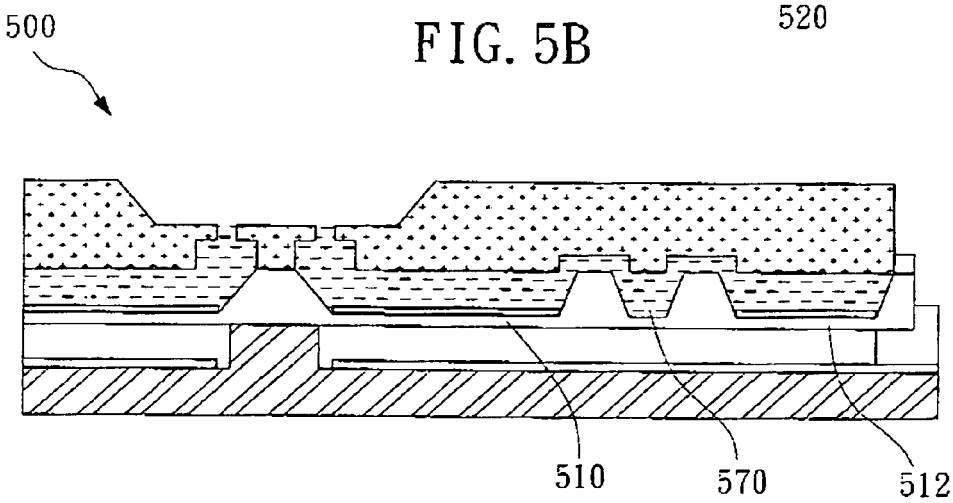

Please refer to FIG. 5A~5C, which are schematic diagrams showing successive actions of an electrostatic inkjet printhead of top-shooter design according to the present invention. The ink ejection procedure starts from the operation seen in FIG. 5C, that is, the main electrostatic actuator 510 and the auxiliary electrostatic actuator 520 is being kept in a designated position and is not deformed while the inkjet printhead 500 is inactive. Following the operation seen in FIG. 5C is the operation seen in FIG. 5A, that is, the main electrostatic actuator 510 is distorted downward by the action of the electrostatic attraction between the electrode 530 and electrode 540 caused by charging the same while the printhead is activated and ready for ink ejection. Following the operation seen in FIG. 5A is the operation seen in FIG. 5B, that is, the electrodes 530 and 540 are disconnected from a power source and instead the electrodes 540 and 550 are connected to be charged with voltage difference so that the distorted main electrostatic actuator 510 is restored to the designated position as the electrostatic attraction disappears and causes the ink in the chamber corresponding to the main electrostatic actuator 510 to be ejected from the nozzle 560, and the same time that the auxiliary electrostatic actuator 520 is distorted downward by the action of the electrostatic attraction between the electrode 540 and electrode 550 caused by charging the same. Finally the procedure returns to the operation seen in FIG. 5C, the auxiliary electrostatic actuator 520 is being restored to the designated position as the electrostatic attraction disappears by disconnecting the electrodes 540 and 550, so that the auxiliary actuator 520 can push the ink store in the chamber corresponding to the same to the ink reservoir 570 and the chamber corresponding to the main electrostatic actuator 510.

The operation sequence of the inkjet printhead 500 is as following:

FIG. 5C→FIG. 5A→FIG. 5B→FIG. 5C

Moreover, as the main electrostatic actuator 510 is activated to eject ink from the nozzle 560, the auxiliary electrostatic actuator 520 is activated immediately after to refill ink to the chamber corresponding to the main electrostatic actuator 510, such that the refill speed of the chamber corresponding to the main electrostatic actuator 510 is increased. In this regard, the inkjet printhead 500 of the invention has a fast response frequency while comparing the same with the printhead of prior arts.

Figure 6:
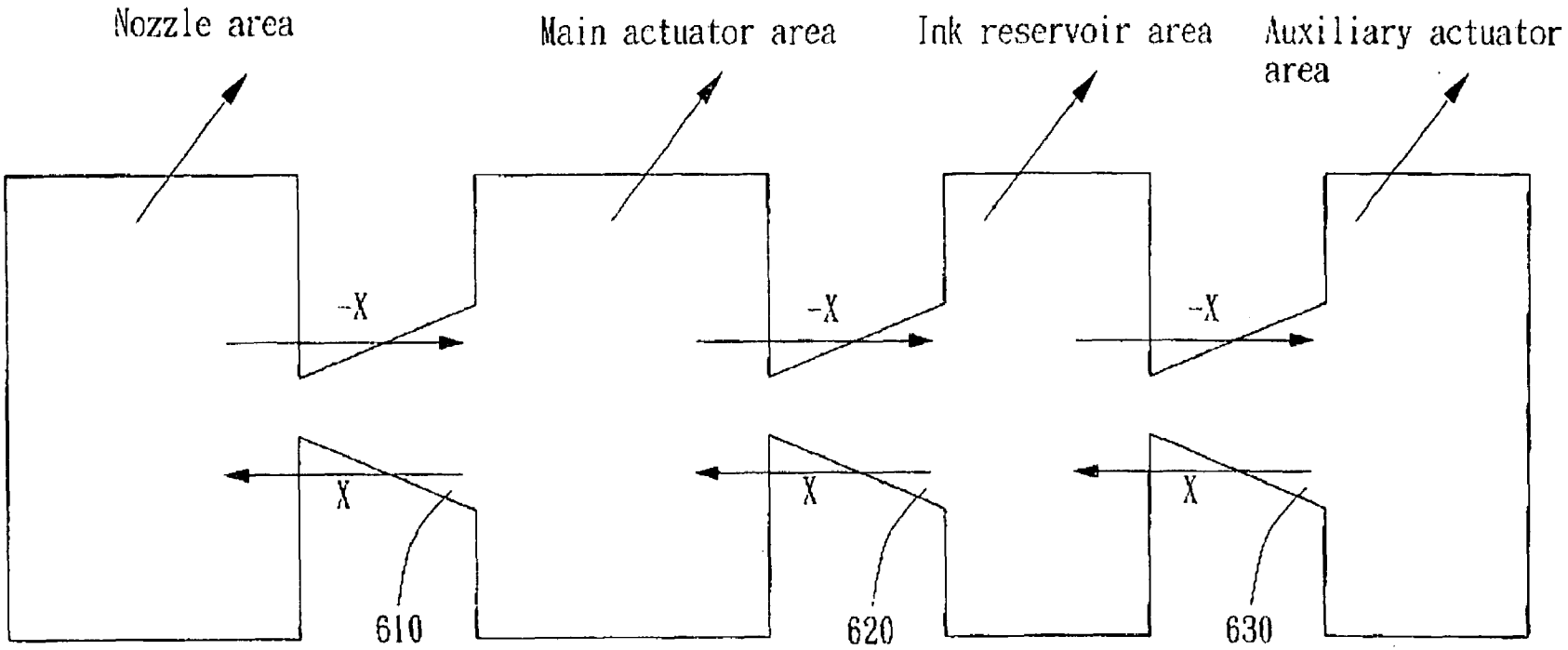
FIG. 6 is a diagram showing the channels in an inkjet printhead according to a preferred embodiment of present invention.

It is noted that the channel connecting the nozzle and the main electrostatic actuator is in a funnel shape that the wider part of the funnel is connected to the main electrostatic actuator and the narrower part of the funnel is connected to the nozzle, such that the amount of ink being pushed back to the ink reservoir can be reduced while the main electrostatic actuator is activated and ejects ink from the nozzle. Please refer to FIG. 6, which is a diagram showing the channels in an inkjet printhead according to a preferred embodiment of present invention. The channels 610, 620 and 630 are all in a funnel shape with wide-entrance-narrow-exit design so that the design enables the ink to flow from the auxiliary electrostatic actuator, ink reservoir, main electrostatic actuator and to the nozzle as directed by arrow X seen in FIG. 6 much more easier than the ink to flow reversely as directed by arrow −X seen in FIG. 6. That is, when the main electrostatic actuator is activated to eject ink from the nozzle, the amount of ink being simultaneously pushed back to the ink reservoir is reduced such that the operation of activating the auxiliary electrostatic actuator to refill the chamber corresponding to the main electrostatic actuator can be performed smoothly.

As the above description, the inkjet printhead of the invention has the following advantages:

a. The response frequency is greatly improved by using at least one auxiliary actuator to assist the main actuator for ink ejection.
b. The monolithic structure of the inkjet printhead of the invention requires only a single wafer bonding process that the accuracy for aligning the substrates of the printhead is improve and also the structure rigidity of the inkjet printhead is enhanced.
c. The channel with wide-entrance-narrow-exit design enables the amount of ink being pushed back to the ink reservoir to be reduced, such that the operation of ink ejection can be performed smoothly and the print quality if improved.

To sum up, the present invention provides an inkjet printhead and process for producing the same, having at least an auxiliary actuator being added in the inkjet printhead structure, is able to increase the frequency response thereof and to increase the positioning precision and structure rigidity of the inkjet printhead by using a single wafer bonding step in the process of producing the same.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An inkjet printhead of top-shooter design, comprising: a first substrate, composed of a first surface and a second surface, having at least a nozzle formed thereon; a second substrate, composed of a first surface and a second surface; wherein the first substrate is connected to the second substrate and the first surface of the second substrate is disposed facing toward the second surface of the first substrate, and the first surface of the second substrate has at least two grooves formed thereon, and the bottom of one of the grooves is a main actuator while the bottom of another groove is an auxiliary actuator, wherein the main actuator is an actuator selected from a group consisting of an electrostatic actuator and a piezoelectric actuator, the auxiliary actuator is an actuator selected from a group consisting of an electrostatic actuator and a piezoelectric actuator, the main actuator and the auxiliary actuator are different.

2. The inkjet printhead of top-shooter design as recited in claim 1, wherein the inkjet printhead has at least an auxiliary actuator.

3. The inkjet printhead of top-shooter design as recited in claim 1, wherein the auxiliary actuator is connected directly to an ink chamber.

4. The inkjet printhead of top-shooter design as recited in claim 1, wherein the auxiliary actuator is arranged next to the main actuator.

5. The inkjet printhead of top-shooter design as recited in claim 1, wherein an ink reservoir is formed on the first surface of the second substrate at a position between the main actuator and the auxiliary actuator.

6. The inkjet printhead of top-shooter design as recited in claim 1, wherein the main actuator is an object of any shape at will.

7. inkjet printhead of top-shooter design as recited in claim 1, wherein the auxiliary actuator is an object of any shape at will.

* * * * *